United States Patent [19]

Arbasak et al.

[11] 4,420,040

[45] Dec. 13, 1983

[54] BALL CATCHER

[75] Inventors: David P. Arbasak; David L. Blake, both of Weston, W. Va.

[73] Assignee: Halliburton Company, Duncan, Okla.

[21] Appl. No.: 375,840

[22] Filed: May 7, 1982

[51] Int. Cl.[3] ..... E21B 23/00; E21B 33/068; B01D 35/28

[52] U.S. Cl. ..... 166/70; 210/305; 210/435; 15/104.06 A; 137/850

[58] Field of Search ..... 210/305, 307, 435, 437, 210/438, 441, 446, 449; 166/70; 15/104.06 A; 251/850, 515.5, 843; 124/49, 20 A, 83

[56] References Cited

U.S. PATENT DOCUMENTS

| | | | |
|---|---|---|---|
| 295,926 | 4/1884 | Learned | 210/449 |
| 756,305 | 4/1904 | Weller | 210/305 |
| 852,584 | 5/1907 | Skinner | 210/435 |
| 1,190,841 | 7/1916 | Bacha et al. | 210/446 |
| 1,677,324 | 7/1928 | Beck et al. | 210/305 |
| 3,171,148 | 3/1965 | Osborn et al. | 15/104.06 A |
| 3,289,762 | 12/1966 | Schell et al. | 166/35 |
| 3,429,108 | 2/1969 | Larson | 137/850 |
| 3,450,114 | 6/1969 | Miles | 137/850 |
| 3,715,055 | 2/1973 | Kendrick et al. | 221/75 |
| 3,846,560 | 12/1969 | Hutchison et al. | 166/292 |
| 3,886,937 | 6/1975 | Bobo et al. | 137/850 |
| 3,937,283 | 2/1976 | Blauer et al. | 166/307 |
| 3,980,136 | 9/1976 | Plummer et al. | 166/280 |
| 4,102,401 | 7/1978 | Erbstoesser | 166/284 |
| 4,172,798 | 10/1979 | Kronsbein | 210/446 |

FOREIGN PATENT DOCUMENTS

| | | | |
|---|---|---|---|
| 234212 | 5/1911 | Fed. Rep. of Germany | 210/435 |

*Primary Examiner*—Charles N. Hart
*Assistant Examiner*—John W. Czaja
*Attorney, Agent, or Firm*—James R. Duzan; Thomas R. Weaver

[57] ABSTRACT

The present invention comprises a ball catcher having a housing which may contain a stinger, baffles, or both such features therein.

1 Claim, 2 Drawing Figures

BALL CATCHER

BACKGROUND OF THE INVENTION

The present invention relates to a ball catcher to be used in hydraulic fracturing operations for oil and gas wells.

Fracturing a formation in a productive zone is often desirable, since it improves the drainage into the well. Several productive formations may be separated by unproductive formations and accordingly it may be desirable to fracture the productive formations, although they are at widely spaced elevations in the well. If multiple fracturing is attempted simultaneously, the position of the fracture cannot be controlled, since a greater pressure is required to initiate a fracture than to extend the fracture into the formation. This problem may be overcome, however, by temporarily plugging the well above the elevation of the formation which has already been fractured, so that the fracture will not absorb the fracturing fluid.

The advantage of fracturing in two or more zones is that it usually increases the rate of production from a well. The increased production, however, is obtained at the expense of conducting two or more separate fracturing operations. This may include the cost of a bridging plug between adjacent fracture zones and the cost of the rig time involved in drilling out a plug which separates two zones, if necessary. The methods previously proposed for temporarily plugging the well, therefore, are relatively expensive. Accordingly, it might not be economical to fracture an upper formation by the conventional techniques, since the extra expense involved would not be justified by the increase in production gained by fracturing the upper formation. However, if the cost of fracturing multiple stages is reduced substantially, then multiple fracturing would be carried out more often, thereby increasing the total production.

To more economically fracture a well having multiple formations therein utilizing a minimum of equipment, the method and apparatus disclosed in U.S. Pat. No. 3,289,762 may be utilized. U.S. Pat. No. 3,289,762 discloses apparatus and a method of fracturing wherein tubing is run into a well with a baffle placed in the string, so that it may be positioned between an upper formation and a lower formation. The tubing is cemented in the well and the tubing opposite the lower formation is perforated by conventional methods. An open hole packer may be placed in the end of the tubing, if the lower portion of the well including the lower formation is an open hole. The casing is then cemented in above the packer and it is not necessary to perforate at the elevation of the lower formation. Fracturing fluid is flowed into the tubing for fracturing the lower formation. After the fracturing has been completed, a ball or plug is pumped down the tubing and lodges on the baffle, between the upper and lower formations. A perforating gun is lowered in the casing to perforate the tubing at the elevation of the upper formation. The upper formation is then fractured and, since the ball covers the opening in the baffle and isolates the lower formation from the fluid pressure above the baffle, the fracturing fluid is forced only through the perforations in the tubing opposite the upper formation. When the fluid pressure in the well is reduced, the fluid in the lower formation is under sufficient pressure to lift the ball off the baffle and to cause the ball to flow to the top of the tubing. Both the upper and lower formations may then produce at the same time.

To provide additional sealing of the perforations into the formation, ball sealers which are of a size which is large enough to seal the perforations in the casing are utilized in addition to the ball or plug and baffle described above. Depending upon the number of perforations in the casing at each formation, at least one ball sealer will be injected for each perforation. A typical apparatus for injecting ball sealers into the flow stream is disclosed in U.S. Pat. No. 3,715,055. A type of ball sealer and ball catcher utilized in hydraulic fracturing operations is described in U.S. Pat. No. 4,102,401.

In many instances, particularly when dealing with gas producing wells, it is desirable to hydraulically fracture the well utilizing a foam composition, such as utilizing a jelled water slurry having sand contained therein mixed with nitrogen or carbon dioxide. Such hydraulic fracturing techniques utilizing a foam composition are described in U.S. Pat. Nos. 3,980,136, 3,937,283 and 3,846,560.

In the past, when hydraulically fracturing either oil or gas wells utilizing the method and apparatus disclosed in U.S. Pat. No. 3,289,762 with either liquids or foam compositions and ball sealers such disclosed in U.S. Pat. No. 4,102,401, when unloading the well of the hydraulic fracturing liquids or portions of the foam compositions to recover the resilient baffle ball or balls utilized to sealingly engage the baffles in the casing and the ball sealers utilized to seal the perforations in the casing, in many instances, the well was merely flowed back through the surface manifolding equipment which had a valve having a swedge connected thereto which would not allow the passage of either a resilient baffle ball or ball sealer therethrough. When either a resilient baffle ball or ball sealer would significantly reduce or block flow through the swedge, the valve would be closed, the swedge removed therefrom, the resilient baffle ball or ball sealer removed from the swedge, the swedge reinstalled on the valve, and the valve reopened until the swedge became blocked thereby reducing or stopping the well flow therethrough then the procedure would be repeated. Since, in many instances, hydraulically fractured wells may be flowed back several days through surface manifolding equipment utilizing the valve and swedge described above to recover the liquids or portions of the foam compositions the resilient baffle balls, and the ball sealers from the producing formations of the well and since several different producing formations may be hydraulically fractured in a single well utilizing a plurality of resilient baffle balls and associated baffles as described in U.S. Pat. No. 3,289,762 as well as a great number of ball sealers, such as described in U.S. Pat. No. 4,102,401, being utilized to seal the perforations in the casing at each formation, it would be necessary to continuously provide personnel to individually remove either the resilient baffle balls and/or the ball sealers from the swedge as the swedge becomes blocked. Additionally, problems may be encountered in removing the swedge due to trapped liquids, compositions and/or gases therein if the valve to which the swedge is connected is leaking.

SUMMARY OF THE INVENTION

To eliminate these problems, the present invention is directed to a ball catcher which is convenient to use in hydraulic fracturing operations, which may be used to catch and retain a large number of resilient baffle balls or ball sealers, or both, without significantly reducing the flow therethrough, which may be easily repaired and which is simple to manufacture. The ball catcher of the present invention comprises a housing having a stinger, baffles, or both, therein.

BRIEF DESCRIPTION OF THE DRAWINGS

The ball catcher of the present invention will be better understood when taken in conjunction with the specification and drawings wherein.

DESCRIPTION OF THE PREFERRED EMBODIMENT

Figure 1:
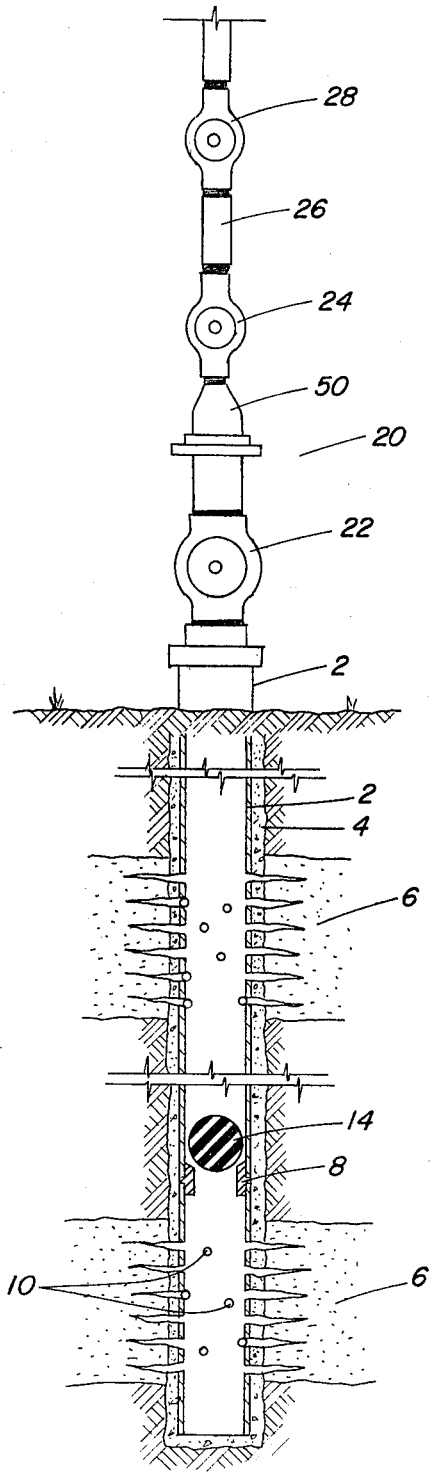
FIG. 1 is a cross-sectional view of a well having the present invention installed in surface equipment connected to the well.

Referring to FIG. 1, the ball catcher 50 of the present invention is shown installed in the surface equipment 20 connected to the casing 2 of a well 4 having a plurality of producing formations 6. When the casing 2 is assembled and cemented in the well 4, one or more baffles 8 may be installed in the casing string so that the hydraulic fracturing method described in U.S. Pat. No. 3,289,762 may be utilized. If the hydraulic fracturing method described in U.S. Pat. No. 3,289,762 is utilized, after the lower formation 6 has been hydraulically fractured, the upper formation 6 may be isolated from the lower formation by a plurality of ball sealers 10 blocking flow through the perforations 12 in the casing 2, and by a resilient baffle ball 14 sealingly engaging the baffle 8 installed in the casing 2.

Installed on the surface and connected to the casing 2 are a valve 22 to control the flow from the formations 6 through the casing 2, the ball catcher 50 of the present invention having the inlet 60 of the housing 52 secured to the outlet of valve 22, choke 24 connected to the outlet 88 of the ball catcher 50, tubing 26 connected to the choke 24 and valve 28.

Figure 2:
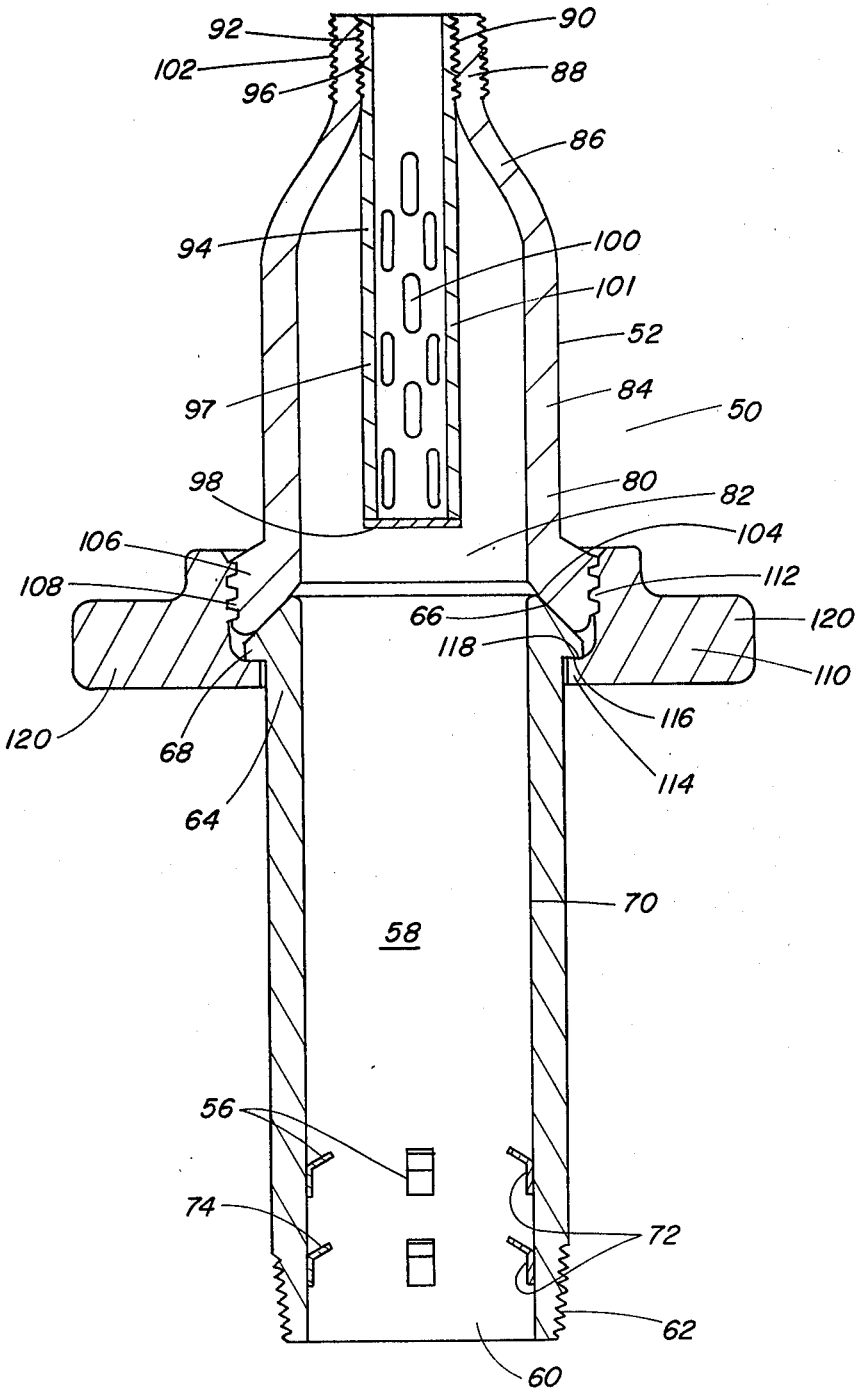
FIG. 2 is a cross-sectional view of the present invention.

Referring to FIG. 2, a preferred embodiment of the ball catcher 50 of the present invention is shown in section. The ball catcher 50 of the present invention, which may be of any convenient size, comprises in its preferred embodiment a separable housing 52, a stinger 94 and a plurality of resilient baffles 56 secured within the separable housing 52.

The separable housing 52 comprises a first cylindrical portion 58 and second cylindrical portion 80. The first cylindrical portion 58 is formed having an inlet 60 thereto, having first end portion 62 of the exterior surface having threads thereon to threadedly engage the outlet valve 22 and having a second end portion 64 having, in turn, a conical end surface 66 and annular shoulder 68 thereon. The conical end surface 66 tapers outwardly from the bore 70 through the first cylindrical portion 58. Disposed in the bore 70 at the inlet 60 of the first cylindrical portion 58 are a plurality of resilient baffles 56.

The resilient baffles 56 are each formed having a first portion 72 secured to the bore 70 and having a lip 74 extending into the bore 70. The resilient baffles 56 may be formed of any suitable material, such as strip steel stock, banding material, etc., and may be secured to the inlet 60 of the first cylindrical portion 58 by any suitable means, such as by welding. The resilient baffles 56 may extend into the bore 70 any desired distance depending upon the diameter of the resilient baffle balls 14 and ball sealers 10 to be retained within the separable housing 52 so long as the baffle balls 14 or ball sealers 10 initially easily pass thereby during well back flow and are retained thereby upon the cessation of well back flow. Also, any desired number of the resilient baffles 56 may be utilized arranged in any fashion concerning their relative circumferential spacing with respect to other resilient baffles 56.

The second cylindrical portion 80 of the separable housing 52 is formed having an inlet 82, having first cylindrical inlet portion 84 and having frusto-conical swedge transition section 86 extending from first cylindrical inlet portion 84 to second cylindrical outlet portion 88. The frusto-conical transition swedge section 86 serves to connect the first cylindrical inlet portion 84 to the smaller second cylindrical end portion 88. The bore 90 of the second cylindrical end outlet portion 88 is formed having threads 92 therein which threadedly receive threaded end portion 96 of stinger 94.

The stinger 94 comprises an elongated annular cylindrical member 97 having a closed end portion 98 and plurality of elongated flow slots 100 through the wall 101 of the cylindrical member 97. Any number of flow slots 100 may be utilized in the stinger 94 depending upon the desired pressure drop of the flow across the stinger 94 and the desired strength of the stinger. The stinger 94 may be constructed of any suitable material depending upon the desired resistance to the abrasion of the stinger 94 by particles produced by the formation 6 during flow back of the fracturing liquids and compositions or the formation fluids after the hydraulic fracturing thereof. The size of the flow slots 100; i.e., their width and length, may be of any convenient size so long as a slot cannot be blocked during well flow back operations by either a resilient baffle ball 14 or ball sealer 10 covering the same. It should be realized that flow slots 100 should be utilized rather than circular holes since circular holes are easily blocked by either a resilient baffle ball 14 or ball sealer 10. The second cylindrical end outlet portion 88 of the second cylindrical portion 80 of the separable housing 52 has the exterior 102 thereof threaded so that valve 24 may be conveniently secured thereto. The inlet 82 of the second cylindrical portion 80 is formed having conical surface 104 therein which mates with conical surface 66 of first cylindrical portion 58 and having annular shoulder 106 thereon which, in turn, is formed having the exterior 108 thereof threaded.

To secure first cylindrical portion 58 to second cylindrical portion 80 a threaded nut 110 is used. The threaded nut 110 is formed having a threaded bore 112 which mates with threaded exterior 108 of second cylindrical portion 80 and having a smaller bore 114 than threaded bore 112 which is slidingly received over the exterior of first cylindrical portion 58 having annular shoulder surface 116 bearing against annular shoulder surface 118 of annular shoulder 68 of first cylindrical portion 58. The threaded nut is additionally formed having a plurality of lugs 120 thereon to assist in tightening the nut 110 on the second cylindrical portion 80. It should be understood that the orientation of the threaded exterior 108 of annular shoulder 106 of second cylindrical portion 80 and annular shoulder 68 of first cylindrical portion 58 may be reversed, if desired, resulting in the reversal of the orientation of the threaded nut 110 on the first 58 and second 80 cylindrical portions respectively.

Similarly, rather than utilizing a threaded first end portion 62 on first cylindrical portion 58 and the threaded exterior 102 of second cylindrical end portion 88 of second cylindrical member 80, the separable housing 52 may be formed having flanged ends or other type suitable ends for connection purposes.

Referring again to FIG. 1, to utilize the ball catcher 50 of the present invention in the flow back of wells 4 after the hydraulic fracturing of a formation or formations 6 thereof the ball catcher 50 in its assembled state is merely secured to the outlet of valve 22 with any desired surface manifolding equipment being secured to the outlet portion 88. When the valve 22 is opened the formation fluids, fracturing liquids and/or compositions flow into the ball catcher 50, through slots 100 in stinger 94 and into the end outlet portion 88 with any resilient baffle balls 14 or ball sealers 10 which flow into the ball catcher 50 being prevented from flowing therethrough by stinger 94. When it is desired to remove any balls or debris from the ball catcher 50, the valve 22 is merely closed, the threaded nut 110 is removed from inlet 82 of second cylindrical portion 80 and the portion 80 separated from first cylindrical portion 58 thereby allowing access to the interior of the ball catcher 50. Any balls or debris in the ball catcher 50 will generally be prevented from falling or moving back into the casing 2 due to fluctuations or cessation in the flow back by the resilient baffles 56. Since the balls flowing into the ball catcher 50 do not prevent the flow back through the catcher 50 since the balls do not seal the slots 100 in the stinger and since the ball catcher 50 may be any convenient size, the ball catcher may catch and retain any desired number of balls before it is required to remove the balls therefrom. Therefore, it is not required for personnel to be present continuously but merely check on the condition of the ball catcher at the wellsite during the well flow back operations after the hydraulic fracturing of the well formations. This significantly reduces costs during well flow back operations.

Additionally, since the stinger 94 is removable from the separable housing 52, upon erosion of the stinger 94 by the abrasion thereof from the fracturing liquids or compositions, formation fluids or particles from the producing formations 6 of the well 4, the stinger 94 may be easily replaced at minimal cost. However, if desired, the stinger 94 may be permanently installed, as by welding, in the separable housing 52. Furthermore, the ball catcher 50 may be easily adapted to wells having a variety of flow back pressures merely by increasing the wall thickness of the materials and the threaded nut.

While the ball catcher of the present invention has been disclosed in its preferred embodiment 50, it should also be understood that the ball catcher of the present invention may be constructed without baffles 56. In such an embodiment, ball catcher 50 may be employed to catch ball sealers 10 during the flow back of a well after fracturing, stinger 94 preventing entrance of the ball sealers into end outlet portion 88.

Furthermore, in the event that hydraulic fracturing of a well is undertaken utilizing baffle balls 14 above, the ball catcher of the present invention may be employed without the use of stinger 94, as long as frustroconical swedge transition section 86 necks down to a diameter smaller than that of the baffle balls 14 to be utilized in the well. Baffles 56 will restrain re-entry of the baffle balls into the well during flowback. If a baffle ball unduly restricts flow into outlet end 88, momentary reduction or cessation of the flow of fluid from the well will tend to take the baffle ball out of the main flow path, so that it will travel downward along the side of the housing until restrained by baffles 56.

Finally, it should be understood that it is not absolutely necessary to employ a separable housing, such as housing 52, in the present invention. A one-piece housing may be employed, and the ball catcher removed from the valve 22 to which it is secured (after closing the valve) when it is to be emptied of balls and/or debris. Alternatively, stinger 94 could be removed after valve 22 is closed to provide access to the interior of the housing. While a single-piece housing is obviously not as convenient as the separable housing 52 of the preferred embodiment, it must be understood that the present invention is not so limited.

Having thus described our invention, we claim:

1. A ball catcher for use in well fluid flow back operations to catch balls used in the hydraulic fracturing of oil and gas wells, the ball catcher comprising:

a separable body housing means having an inlet and outlet thereto, the separable body housing means comprising:

first cylindrical portion means having a conical end surface means and annular shoulder means on one end thereof;

second cylindrical portion means including:

first cylindrical inlet portion means having an inlet and having, in turn, conical end surface means which mate with conical end surface means of the first cylindrical portion means and annular shoulder means thereon;

second cylindrical outlet portion means having the interior thereof formed having threads thereon; and frusto-conical swedge transition section means having one end secured to the first cylindrical inlet portion means and the other end secured to the second cylindrical outlet portion means; and threaded nut means releasably securing the first cylindrical portion means to the second cylindrical portion means;

stinger means comprising elongated annular cylindrical member means having a closed end portion, the other end portion having the exterior thereof formed having threads thereon thereby releasably connecting the cylindrical member means to the outlet of the second cylindrical outlet portion means of the second cylindrical portion means of the separable body housing means and a plurality of elongated slot means through the wall of the elongated annular cylindrical member means; and resilient baffle means secured to the interior of the separable body housing means, the resilient baffle means comprising:

a plurality of resilient baffle means, each resilient baffle means having a first portion secured to the separable body housing means and a second lip portion extending into the interior of the separable body housing means whereby said balls in said well fluid flowing back through said ball catcher are caught and substantially retained in the interior of said ball catcher between the stinger means and the resilient baffle means.

* * * * *